US010422601B2

(12) United States Patent
Harris

(10) Patent No.: US 10,422,601 B2
(45) Date of Patent: Sep. 24, 2019

(54) LOCKING BOX MAGAZINE SAFETY DEVICE

(71) Applicant: James Harris, Belfair, WA (US)

(72) Inventor: James Harris, Belfair, WA (US)

( * ) Notice: Subject to any disclaimer, the term of this patent is extended or adjusted under 35 U.S.C. 154(b) by 0 days.

(21) Appl. No.: 15/216,673

(22) Filed: Jul. 21, 2016

(65) Prior Publication Data

US 2018/0023911 A1 Jan. 25, 2018

(51) Int. Cl.
*F41A 17/44* (2006.01)
*F41A 9/65* (2006.01)

(52) U.S. Cl.
CPC ..... *F41A 17/44* (2013.01); *F41A 9/65* (2013.01)

(58) Field of Classification Search
CPC ..... F41A 17/44
USPC ..... 42/70.02
See application file for complete search history.

(56) References Cited

U.S. PATENT DOCUMENTS 2,530,560 A * 11/1950 Young ..... F41A 17/44 42/70.01
3,018,576 A * 1/1962 Riechers ..... F41A 17/44 42/70.01
3,089,272 A * 5/1963 McKinlay ..... F41A 17/44 42/70.11
3,208,176 A * 9/1965 Giles ..... F41A 17/44 42/66
3,237,335 A * 3/1966 Kerr ..... F41A 19/41 102/444
3,378,943 A * 4/1968 Valburg ..... F41A 17/44 42/70.11
3,382,596 A * 5/1968 Rockwood ..... F41A 17/44 42/70.01
3,708,901 A * 1/1973 Wolter ..... F41A 17/44 42/70.11
3,710,490 A * 1/1973 Cornett ..... F41A 17/44 42/70.11
3,720,014 A * 3/1973 Goodrich ..... F41A 17/44 42/70.11
4,100,691 A * 7/1978 Wicklund ..... F41A 9/53 42/1.05
4,261,127 A * 4/1981 Karkkainen ..... F41A 17/02 42/70.11
4,384,420 A * 5/1983 Von Muller ..... F41A 17/44 42/70.11
4,532,729 A * 8/1985 Von Muller ..... F41A 17/44 42/70.11
4,569,144 A * 2/1986 Thurber ..... F41A 17/44 42/70.11
4,619,062 A * 10/1986 Johnson ..... F41A 17/42 42/49.02

(Continued)

*Primary Examiner* — Joshua E Freeman
*Assistant Examiner* — Bridget A Cochran
(74) *Attorney, Agent, or Firm* — Brian S. Boon; Brian R. Galvin; Galvin Patent Law LLC

(57) ABSTRACT

A locking box magazine safety device, comprising a magazine body comprising a rigid material shaped to conform to the internal dimensions and features of a box magazine well in a magazine-operated device; a lock cylinder comprising a key-operated lock and an operating rod, the operating rod configured to move when the appropriate key is used in the key-operated lock; and a pivoting arm configured to pivot about an axis, configured to be fixed in place by the movement of the operating rod, and configured to obscure the action of a magazine-operated device when fixed in place.

6 Claims, 3 Drawing Sheets

(56) References Cited

U.S. PATENT DOCUMENTS 4,654,992 A * 4/1987 Lavergne ..... F41A 17/02 42/70.01
4,761,906 A * 8/1988 Guevara ..... F41A 17/36 42/66
4,835,894 A * 6/1989 Libassi ..... F41A 17/44 42/70.11
4,965,952 A * 10/1990 Miller ..... F41A 17/44 42/1.05
5,014,457 A * 5/1991 Lewis ..... F41A 17/44 42/70.11
5,052,142 A * 10/1991 Mikus ..... F41A 17/44 42/70.11
5,054,223 A * 10/1991 Lee ..... F41A 17/44 42/70.11
5,070,635 A * 12/1991 Cvetanovich ..... F41A 17/44 42/70.11
5,081,779 A * 1/1992 Pack ..... F41A 17/74 42/70.11
5,097,613 A * 3/1992 Miller ..... F41A 17/44 42/1.05
5,171,924 A * 12/1992 Honey ..... F41A 17/44 42/66
5,179,234 A * 1/1993 Cvetanovich ..... F41A 17/44 42/70.11
5,241,769 A * 9/1993 Von Muller ..... F41A 17/02 42/70.04
5,271,174 A * 12/1993 Bentley ..... F41A 17/44 42/70.11
5,291,832 A * 3/1994 Plummer ..... F42B 8/08 102/444
5,315,778 A * 5/1994 Wolford ..... F41A 17/44 102/511
5,361,525 A * 11/1994 Bowes ..... F41A 17/02 42/70.06
5,394,635 A * 3/1995 Stuart ..... F41A 17/44 102/447
5,410,832 A * 5/1995 Barnhart ..... F41A 17/44 42/1.05
5,419,069 A * 5/1995 Mumbleau ..... F41A 17/02 42/70.11
5,465,519 A * 11/1995 Blanck ..... F41A 17/02 42/70.01
5,680,724 A * 10/1997 Peterken ..... F41A 17/44 42/70.11
5,782,029 A * 7/1998 Brooks ..... F41A 17/02 42/70.11
5,950,344 A * 9/1999 Ross ..... F41A 17/44 42/70.11
6,041,536 A * 3/2000 Samuels ..... F41A 17/44 42/70.11
6,052,934 A * 4/2000 Carpenter ..... F41A 17/44 42/70.11
6,170,186 B1 * 1/2001 Reed ..... F41A 17/44 42/66
6,223,657 B1 * 5/2001 Proffitt ..... F42B 8/08 102/444
6,237,272 B1 * 5/2001 Scott ..... F41A 17/44 42/70.11
6,250,008 B1 * 6/2001 Silver ..... F41A 17/44 42/70.01
6,256,919 B1 * 7/2001 Brazeau ..... F41A 17/44 42/70.04
6,408,556 B1 * 6/2002 Achee ..... F41A 17/44 42/70.11
6,412,207 B1 * 7/2002 Crye ..... F41A 17/02 42/70.01
6,470,615 B1 * 10/2002 Peterken ..... F41A 17/44 42/70.01
6,499,244 B1 * 12/2002 Smith ..... F41A 17/44 42/70.11
6,510,639 B2 * 1/2003 McMoore ..... F41A 17/20 42/70.06
6,543,170 B2 * 4/2003 Beretta ..... F41A 17/74 42/70.08
6,584,718 B1 * 7/2003 Serrao ..... F41A 17/02 42/44
6,604,313 B1 * 8/2003 Kress ..... F41A 17/44 42/70.11
6,626,674 B2 * 9/2003 Chudwin ..... F41A 17/44 42/70.01
6,725,592 B2 * 4/2004 Reed ..... F41A 17/44 42/70.11
6,755,054 B2 * 6/2004 Burmesch ..... E05B 67/36 42/70.11
6,862,831 B1 * 3/2005 Canaday ..... F41A 17/44 42/66
6,871,438 B2 * 3/2005 Lawless ..... F41A 33/00 42/70.01
7,051,468 B2 * 5/2006 Glock ..... F41A 17/02 42/70.01
7,121,033 B1 * 10/2006 Waller ..... F41A 17/04 42/70.11
7,150,122 B1 * 12/2006 Ha ..... F41A 17/44 42/66
7,222,450 B2 * 5/2007 Cuprin ..... F41A 17/066 42/70.11
7,543,403 B1 * 6/2009 Schaefer ..... F41A 17/02 42/70.02
8,850,738 B2 * 10/2014 Silver ..... F41C 27/00 42/1.05
2003/0172572 A1 * 9/2003 Clark ..... F41A 17/44 42/70.11
2005/0115131 A1 * 6/2005 Markbreit ..... F41A 17/44 42/70.11
2006/0288625 A1 * 12/2006 Williams ..... F41A 17/54 42/70.11
2012/0285063 A1 * 11/2012 Woodford ..... F41A 17/42 42/70.11
2013/0008070 A1 * 1/2013 Bitsack ..... F41A 29/04 42/70.11
2015/0233661 A1 * 8/2015 Koerner ..... F41A 17/44 42/70.11

* cited by examiner

LOCKING BOX MAGAZINE SAFETY DEVICE

CROSS-REFERENCE TO RELATED APPLICATIONS

None.

BACKGROUND OF THE INVENTION

Field of the Art

The disclosure relates to the field of safety devices, and more particularly to the field of safety devices for locking and disabling the action of tools or weapons with a box magazine.

Discussion of the State of the Art

There are a variety of firearm safety devices known in the art, such as integral locking mechanisms designed to render a firearm inert unless a key is used to unlock prior to use, or external locks that loop through the barrel and action of a firearm and lock in place, to secure the firearm for storage or transport. These designs leave some aspects of safety or practicality unanswered, however. In the case of the former, a locked firearm may still accept a magazine or live ammunition, which can be a safety or legal concern (for example, a locked firearm may be used in this manner to transport ammunition through prohibited areas unnoticed). In the case of the latter, a firearm locked via a cable or chain lock through the action and barrel generally will no longer fit properly in storage containers such as transportation cases or holsters, that are generally designed to fit a particular firearm as closely as possible.

What is needed, is a firearm safety device that securely locks the action and magazine of a firearm without adding additional external bulk, so that it may still be transported or stored normally.

SUMMARY OF THE INVENTION

Accordingly, the inventor has conceived and reduced to practice, in a preferred embodiment of the invention, a locking box magazine safety device that securely locks the action of a firearm while also occupying the magazine well or opening, preventing the insertion of a magazine or live ammunition while retaining the original exterior profile of the firearm for safe transport and storage.

To address the need for a safety device that securely locks the action and magazine of a firearm without adding altering the external profile of the firearm, the inventors have conceived and reduced to practice a device that inserts into a magazine opening or well of a firearm, occupying the space as a standard magazine would. The device then inserts a formed plug into the chamber of the barrel of the firearm, and locks into place by the action of a key in the base of the safety device (where a standard magazine's floorplate would be), locking the chamber plug into place and preventing removal even if the firearm's magazine release is activated. This fully locks the action of the firearm by immobilizing the barrel (preventing the function of a wide variety of firearm actions utilizing a variety of moving-barrel designs), while simultaneously occupying the chamber and magazine well and thus preventing the insertion of ammunition or magazines into the firearm. This prevents the operation of the firearm as well as preventing it from accepting ammunition, rendering it inert and ensuring it is free of any live ammunition for optimal storage and transport.

Additionally, the design of the safety device envisioned by the inventors may be readily adapted to non-firearm devices that utilize some form of barrel and magazine assembly, such as a variety of pneumatic or electric tools. For example, a nail gun may operate using a box or drum magazine for storing and loading nails for rapid fastening, such as for use in roofing applications. A locking box magazine safety device may be inserted in place of a nail magazine, locking the action and preventing the insertion of a magazine or loose nails, thus ensuring that even if power is supplied to the tool, there is no risk of discharge.

According to a preferred embodiment of the invention, a locking box magazine safety device, comprising: a magazine body comprising a rigid material shaped to conform to the internal dimensions and features of a box magazine well in a magazine-operated device; a lock cylinder comprising a key-operated lock and an operating rod, the operating rod configured to move when the appropriate key is used in the key-operated lock; and a pivoting arm configured to pivot about an axis, configured to be fixed in place by the movement of the operating rod, and configured to obscure the action of a magazine-operated device when fixed in place, is disclosed.

BRIEF DESCRIPTION OF THE DRAWING FIGURES

The accompanying drawings illustrate several embodiments of the invention and, together with the description, serve to explain the principles of the invention according to the embodiments. It will be appreciated by one skilled in the art that the particular embodiments illustrated in the drawings are merely exemplary, and are not to be considered as limiting of the scope of the invention or the claims herein in any way.

DETAILED DESCRIPTION

Figure 1:
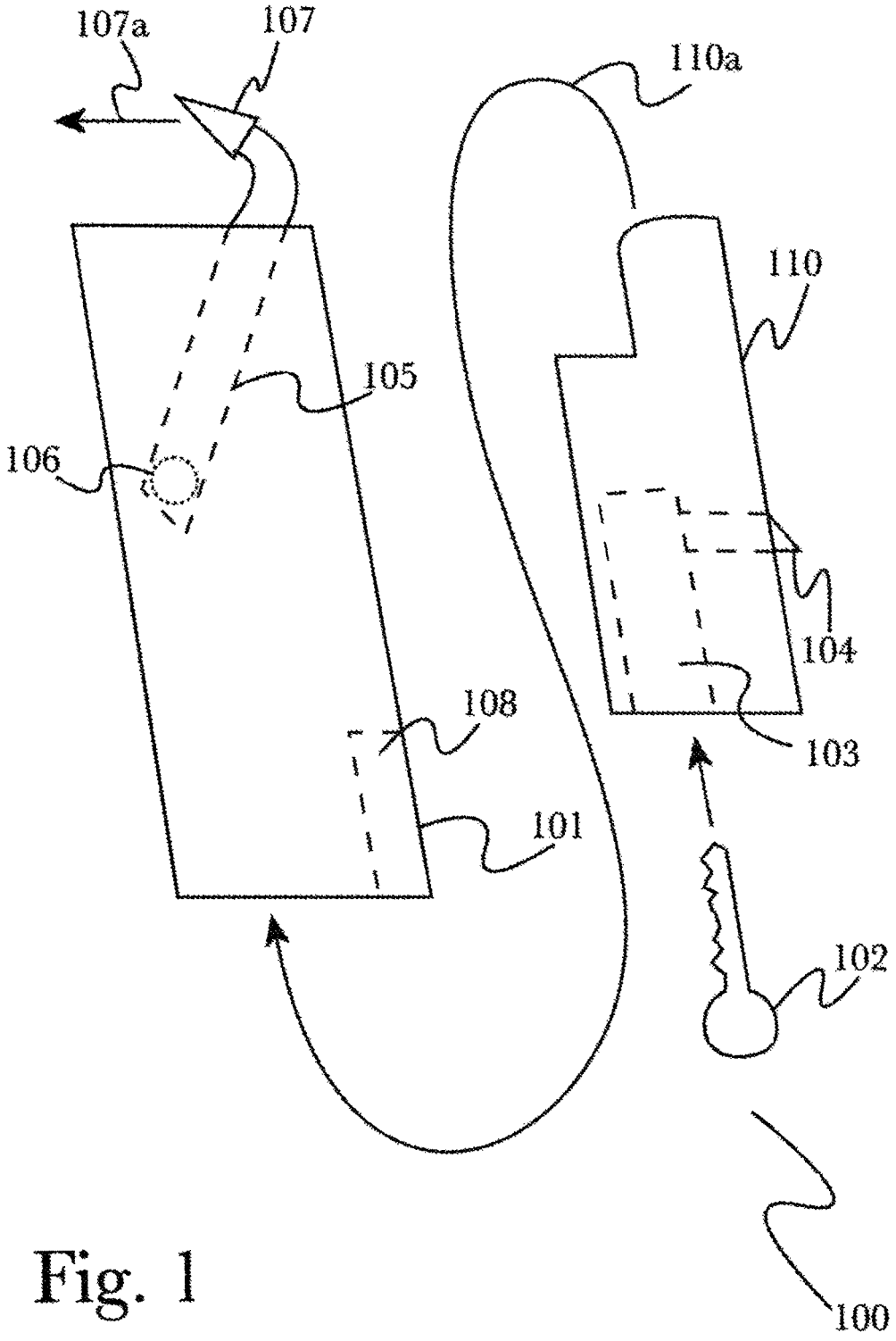
FIG. 1 is a diagram of an exemplary arrangement of a locking box magazine safety device, illustrating a basic design configured for use in a firearm, according to a preferred embodiment of the invention.

The inventor has conceived, and reduced to practice, in a preferred embodiment of the invention, a locking box magazine safety device that securely locks the action of a firearm while also occupying the magazine well or opening, preventing the insertion of a magazine or live ammunition while retaining the original exterior profile of the firearm for safe transport and storage.

One or more different inventions may be described in the present application. Further, for one or more of the inventions described herein, numerous alternative embodiments may be described; it should be appreciated that these are presented for illustrative purposes only and are not limiting of the inventions contained herein or the claims presented herein in any way. One or more of the inventions may be widely applicable to numerous embodiments, as may be readily apparent from the disclosure. In general, embodiments are described in sufficient detail to enable those skilled in the art to practice one or more of the inventions, and it should be appreciated that other embodiments may be utilized and that structural, logical, software, electrical and other changes may be made without departing from the scope of the particular inventions. Accordingly, one skilled in the art will recognize that one or more of the inventions may be practiced with various modifications and alterations. Particular features of one or more of the inventions described herein may be described with reference to one or more particular embodiments or figures that form a part of the present disclosure, and in which are shown, by way of illustration, specific embodiments of one or more of the inventions. It should be appreciated, however, that such features are not limited to usage in the one or more particular embodiments or figures with reference to which they are described. The present disclosure is neither a literal description of all embodiments of one or more of the inventions nor a listing of features of one or more of the inventions that must be present in all embodiments.

Headings of sections provided in this patent application and the title of this patent application are for convenience only, and are not to be taken as limiting the disclosure in any way.

A description of an embodiment with several components in communication with each other does not imply that all such components are required. To the contrary, a variety of optional components may be described to illustrate a wide variety of possible embodiments of one or more of the inventions and in order to more fully illustrate one or more aspects of the inventions. Similarly, although process steps, method steps, algorithms or the like may be described in a sequential order, such processes, methods and algorithms may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred. Also, steps are generally described once per embodiment, but this does not mean they must occur once, or that they may only occur once each time a process, method, or algorithm is carried out or executed. Some steps may be omitted in some embodiments or some occurrences, or some steps may be executed more than once in a given embodiment or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments of one or more of the inventions need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Process descriptions or blocks in figures should be understood as representing modules, segments, or portions of code which include one or more executable instructions for implementing specific logical functions or steps in the process. Alternate implementations are included within the scope of embodiments of the present invention in which, for example, functions may be executed out of order from that shown or discussed, including substantially concurrently or in reverse order, depending on the functionality involved, as would be understood by those having ordinary skill in the art.

Detailed Description of Exemplary Embodiments

FIG. 1 is a diagram of an exemplary arrangement of a locking box magazine safety device 100, illustrating a basic design configured for use in a firearm, according to a preferred embodiment of the invention. According to the embodiment, a locking box magazine safety device 100 may comprise a magazine body 101 generally configured to be similar in shape and design as a standard magazine for a firearm (or other magazine-operated device such as some power tools) with which it is intended to be used, or may be a "one size fits most" design with dimensions adjusted to fit in a variety of similar designs. For example, magazine body 101 may be shaped to work with a wide range of single-stack handguns such as (for example, including but not limited to) various models based on the 1911 design pattern, as well as various single-stack models produced by different manufacturers (often using similar designs within a manufacturer's product lineup for the sake of manufacturing simplicity and parts interchangeability). By varying the angle and dimensions of body 101 it may be possible to fit a wide range of models or designs with a single safety device 100.

A key 102 may be used to lock and unlock a locking cylinder 103 inside a locking magazine insert 110 that may be inserted into a magazine body 101, locking the movement of an operating rod 104 to secure locking insert 110 within magazine body 101 by mechanical resistance against an integrally-formed block 108 within the magazine body, to prevent removal of locking insert 110 when locked into place. A pivoting arm 105 may be locked into a forward position 107*a* by the insertion of locking insert 110 and pivoted around a pin 106 or other joint integral to magazine body 101, securing a chamber plug 107 inside the chamber of the firearm's barrel and preventing live ammunition from being inserted while simultaneously preventing removal of the safety device 100. Plug 107 may be shaped to fit a particular model or caliber of firearm, or may be of a conical or tapered design as shown to allow use with a range of calibers or designs. For example, using a tapered plug 107 a single safety device 100 may be compatible with a range of similar designs (with which magazine body 101 is compatible) made in different calibers, for example in 1911-based handgun designs or models produced by GLOCK™ that may use similar magazine well dimensions but may be chambered in a wide variety of calibers without significantly altering the design overall (generally only changing the barrel dimensions and spring weights). When pivoted thusly, arm 105 moves 105*a* within magazine body 101 and operating rod 104 may be extended into place 104*a* and locked, preventing the arm 105 from being pivoted again to facilitate removal.

Additionally, key 102 may be used only for unlocking and removal, with an automatically-engaging or always-engaged lock mechanism such that fully inserting locking insert 110 into magazine body 101 within a firearm or other magazine-operated device is sufficient to lock the action, and the only way to unlock is with key 102 (this operation mode is similar to some filing cabinet and door locks that automatically engage when fully closed, and a key is then needed to reopen). This may be used to facilitate safely securing a firearm or other device without needing a key, for example to secure an item for transport while the owner retains possession of the key to unlock after reaching their destination, or to secure a number of devices such as firearms in an armory, with a single key in possession of the quartermaster or supervisor so that anyone may replace and securely lock an item but only the authorized key-bearer may unlock and remove them.

Locking cylinder 103 may be integrally-formed within locking insert 110, or may be removable or part of a larger removable sub-assembly or insert, for example to have a single locking cylinder 103 that may be used interchangeably with a variety of locking inserts 110 configured for use with various magazine bodies 101 configured for use in different firearms or devices (for example, so that a single key may be used to secure a variety of firearms one at a time, for a "universal" design that may be convenient for locking large numbers of devices). It should be appreciated that a variety of locking mechanisms may be utilized in a locking cylinder 103 design, and that the particular construction of a lock 103 may not substantially alter the function as described. For example, a simple tumbler lock may be utilized for simplicity of manufacture or to lower costs, or a complex anti-tamper lock design may be used to increase safety. Locking cylinder 103 and operating rod 104 may also be arranged according to the design or intended use of magazine body 101, for example to accommodate specific device designs with different magazine well dimensions or features, such as for use in a rifle or power tool, as described below (referring to FIG. 2).

Figure 2:
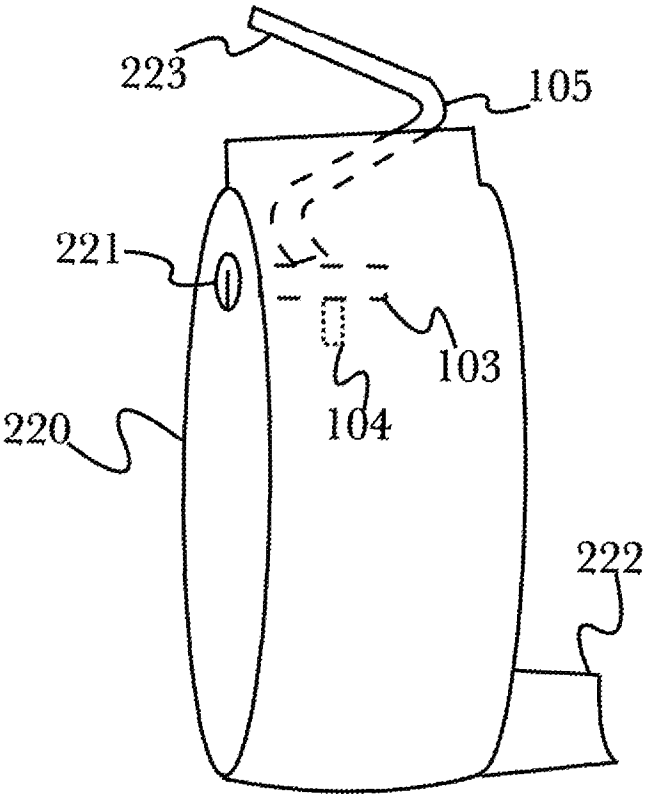
FIG. 2 is an illustration of alternate exemplary arrangements of a locking box magazine safety device, illustrating alternate designs configured for use with a rifle and a box-fed power tool.
Figure 2:
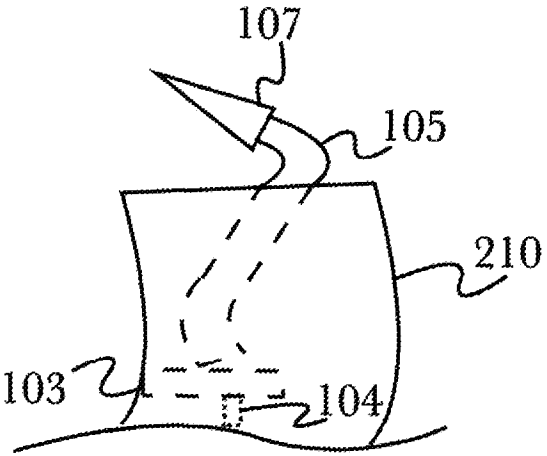

FIG. 2 is an illustration of alternate exemplary arrangements of a locking box magazine safety device, illustrating alternate designs configured for use with a rifle 210 and a box-fed power tool 220. According to the embodiment, a locking box magazine safety device 210 may be configured for use with a rifle, shotgun, or other long arm with a locking cylinder 103 positioned perpendicular to a pivoting arm 105, using an operating rod 104 that rotates into place to lock the position of arm 105 when inserted into the magazine well of a firearm. A chamber plug 107 may be inserted into the chamber of the firearm, optionally using a tapered or stepped design to closely fit the chamber shape of a rifle (generally having a stepped shape to accommodate necked ammunition cartridges) or to fit a variety of different calibers using a single safety device 210 (for example, many rifle designs may be re-barreled in various calibers for different purposes such as target shooting or hunting).

A locking box magazine safety device 220 may also be configured in a drum-shaped design for use with non-firearm devices that operate using a removable box magazine, such as some power tools including (for example, and not limited to) electromagnetic or pneumatic nail guns. In such a configuration, safety device 220 may comprise a locking lug 222 or other fastening device used to secure the magazine to the tool during use, for example a pivoting hinge enabling the safety device 220 to be rotated into place. A lock 221 may be placed on the face of the drum portion of the safety device 220 for easy access when in place, and may comprise an internal locking cylinder 103 with an operating rod 104 that rotates into place when a key is turned, locking the position of a pivoting arm 105 to lock or unlock the action of the tool. A chamber plug 223 may be formed according to the nature of the particular tool, for example a long and narrow cylindrical plug as shown for use with a nail gun, designed to be inserted into the barrel of the nail gun to prevent any nails from being inserted while safety device 220 is locked into place. This may be used to prevent the operation of a nail gun or other tool, both by preventing the loading of a standard magazine and by preventing manual insertion of a nail or other projectile into a barrel (for example, to be fired singly using pneumatic action without a magazine).

Figure 3:
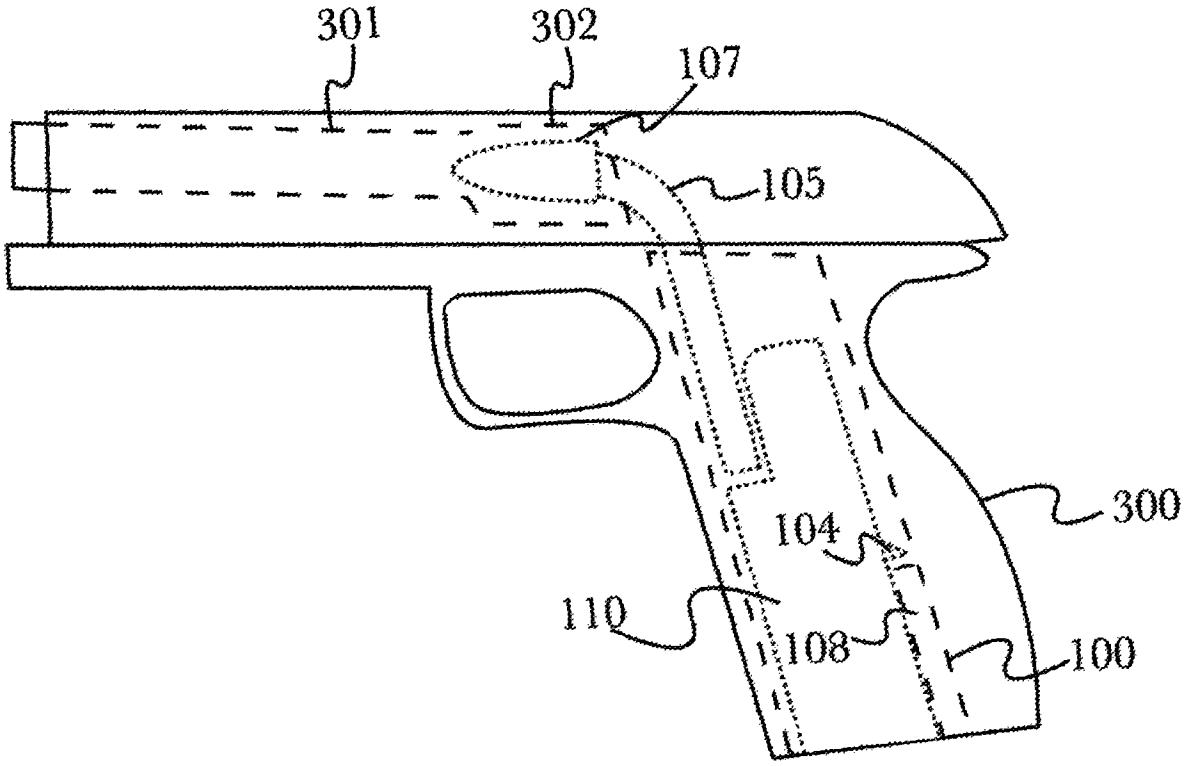
FIG. 3 is an illustration of an exemplary handgun with a locking box magazine safety device installed, illustrating the use of a locking box magazine safety device acting to prevent operation of the firearm.

FIG. 3 is an illustration of an exemplary handgun 300 with a locking box magazine safety device 100 installed, illustrating the use of a locking box magazine safety device 100 acting to prevent operation of the firearm 300. When a locking box magazine safety device 100 is inserted into a magazine well of firearm 300, pivoting arm 105 may be moved forward to insert a chamber plug 107 into the chamber 302 of the barrel 301 of firearm 300. An operating rod 104 may then be moved into position to prevent further movement of pivoting arm 105, for example by turning a key in a lock cylinder 103 to operate the operating rod 104 and move it into place. In this manner, it can be appreciated that the locking box magazine safety device 100 may be locked into place within the magazine well of a firearm 300, preventing removal and thus preventing the insertion of a standard magazine while also obstructing the chamber 302 and thus preventing the manual insertion of any live ammunition. This may be accomplished with minimal change to the firearm's external profile, as the action may be permitted to close nearly fully as shown, allowing the firearm to be safely stored in standard cases or holsters while locked in this fashion, thus rendering the firearm safe until the proper key is used to unlock and remove the safety device 100 prior to use.

The skilled person will be aware of a range of possible modifications of the various embodiments described above. Accordingly, the present invention is defined by the claims and their equivalents.

What is claimed is:

1. A locking box magazine safety device, comprising:

a magazine body comprising a rigid material shaped to conform to the internal dimensions and features of a box magazine well in a magazine-operated device;

a lock cylinder comprising a key-operated lock and an operating rod, the operating rod configured to move in a single direction without the use of a key, and in the opposite direction only when an appropriate key is used in the key-operated lock; and a pivoting arm configured to pivot about an axis into the firing chamber of a magazine-operated device, configured to be fixed in place by the movement of the operating rod, and configured to fill a portion of the firing chamber of the magazine-operated device when fixed in place.

2. The device of claim 1, wherein the magazine-operated device is a firearm.

3. The device of claim 1, wherein the magazine-operated device is a magazine-operated power tool.

4. The device of claim 2, wherein the pivoting arm further comprises a shaped firing chamber plug comprising a rigid material configured to conform to the internal dimensions and features of the firearm's barrel.

5. The device of claim 4, wherein the shaped firing chamber plug is configured having a tapered shape to allow use with a plurality of firearm firing chambers of varying internal dimensions or features.

6. A locking box magazine safety device, comprising:

a magazine body comprising a rigid material shaped to conform to the internal dimensions and features of a box magazine well in a magazine-operated firearm;

a lock cylinder comprising a key-operated lock and an operating rod, the operating rod configured to move in a single inward direction without the use of a key, and in the opposite direction only when an appropriate key is used in the key-operated lock; and a pivoting arm configured to pivot about an axis into the firing chamber of a magazine-operated device, configured to be fixed in place by the inward movement of the operating rod, and configured to fill a portion of the firing chamber of the magazine-operated device when fixed in place;

wherein the axis about which the pivoting arm pivots is perpendicular to the lengthwise axis of the barrel of the magazine-operated firearm and perpendicular to the lengthwise axis of the box magazine.

* * * * *